US011460045B2

(12) United States Patent
Pirouzpanah et al.

(10) Patent No.: US 11,460,045 B2
(45) Date of Patent: Oct. 4, 2022

(54) CENTRIFUGAL BLOWER ASSEMBLY AND METHOD FOR ASSEMBLING THE SAME

(71) Applicant: REGAL BELOIT AMERICA, INC., Beloit, WI (US)

(72) Inventors: Sahand Pirouzpanah, Miamisburg, OH (US); Rajavel Balaguru, Red Lion, PA (US); Padmasri Nanduri, Telangana (IN); Joseph Aaron Henry, Dayton, OH (US); Shirish Vatkar, Tipp City, OH (US)

(73) Assignee: Regal Beloit America, Inc., Beloit, WI (US)

( * ) Notice: Subject to any disclaimer, the term of this patent is extended or adjusted under 35 U.S.C. 154(b) by 0 days.

(21) Appl. No.: 17/518,266

(22) Filed: Nov. 3, 2021

(65) Prior Publication Data

US 2022/0056924 A1 Feb. 24, 2022

Related U.S. Application Data

(62) Division of application No. 16/219,291, filed on Dec. 13, 2018, now Pat. No. 11,193,499.
(Continued)

(51) Int. Cl.
*F04D 29/42* (2006.01)
*F04D 17/08* (2006.01)
(Continued)

(52) U.S. Cl.
CPC ..... *F04D 29/4226* (2013.01); *F04D 17/08* (2013.01); *F04D 29/422* (2013.01);
(Continued)

(58) Field of Classification Search
CPC .... F04D 29/4226; F04D 29/422; F04D 29/44; F04D 29/46; F04D 29/62; F04D 17/08
See application file for complete search history.

(56) References Cited

U.S. PATENT DOCUMENTS 3,093,299 A 6/1963 Hammann et al.
5,772,399 A 6/1998 Mehta et al.
(Continued)

FOREIGN PATENT DOCUMENTS

EP 1378668 B1 1/2004
EP 1924772 B1 5/2008
WO 2012177767 A2 12/2012

*Primary Examiner* — Sabbir Hasan
(74) *Attorney, Agent, or Firm* — Armstrong Teasdale LLP

(57) ABSTRACT

A centrifugal blower assembly includes a scroll wall, a pair of opposing sidewalls, and a cutoff plate. The scroll wall is positioned between the pair of opposing sidewalls such that the scroll wall and opposing sidewalls together define a blower chamber and a blower outlet. The scroll wall extends circumferentially between a cutoff point to an end point and defines a cutout extending circumferentially from the cutoff point. The scroll wall, the pair of opposing sidewalls, and the cutoff point define a blower outlet, wherein the blower outlet defines a blower outlet area. The cutoff plate extends circumferentially from the end point. The cutoff plate defines a notch defining a notch area, the notch area and the blower outlet area define a total blower outlet area, wherein the notch includes a center portion that defines a portion of an elliptical shape.

12 Claims, 20 Drawing Sheets

Related U.S. Application Data

(60) Provisional application No. 62/599,170, filed on Dec. 15, 2017.

(51) Int. Cl.
*F04D 29/62* (2006.01)
*F04D 29/44* (2006.01)
*F04D 29/16* (2006.01)

(52) U.S. Cl.
CPC ..... *F04D 29/44* (2013.01); *F04D 29/62* (2013.01); *F04D 29/162* (2013.01)

(56) References Cited

U.S. PATENT DOCUMENTS

| | | | | |
|---|---|---|---|---|
| 6,254,336 | B1 | 7/2001 | Ahn | |
| 7,108,478 | B2 | 9/2006 | Hancock | |
| 7,144,219 | B2 | 12/2006 | Hancock | |
| 8,197,193 | B2 * | 6/2012 | Messmer | F04D 29/4226 415/126 |
| 2013/0343865 | A1 | 12/2013 | Hancock | |
| 2014/0023536 | A1 * | 1/2014 | Post | F04D 25/0653 415/206 |
| 2014/0158463 | A1 | 6/2014 | Wiegers et al. | |
| 2015/0377249 | A1 * | 12/2015 | Cocks | F04D 29/444 415/203 |
| 2016/0084268 | A1 * | 3/2016 | Cocks | H02P 23/00 415/119 |

* cited by examiner

CENTRIFUGAL BLOWER ASSEMBLY AND METHOD FOR ASSEMBLING THE SAME

CROSS REFERENCE TO RELATED APPLICATIONS

This application is a divisional of and claims the benefit of and priority to U.S. patent application Ser. No. 16/219,291, filed Dec. 13, 2018, which claims the benefit of and priority to U.S. Provisional Patent Application Ser. No. 62/599,170, filed Dec. 15, 2017, which are both incorporated herein by reference in its entirety.

BACKGROUND

The field of the disclosure relates generally to a housing for a centrifugal fan, and more specifically, to methods and apparatus for an adjustable centrifugal blower discharge.

Centrifugal fans or blowers are commonly used in the automotive, air handling and ventilation industries for directing large volumes of forced air, over a wide range of pressures, through a variety of air conditioning components. In a known centrifugal blower, air is drawn into a housing through one or more inlet openings by a rotating wheel. This air is then forced around the housing and out an outlet end that includes a cutoff point where a casing of the centrifugal blower intersects a discharge of the centrifugal blower. Known centrifugal blowers include an outlet including a fixed or otherwise flat cutoff. These fixed or flat cutoff geometries may decrease the overall efficiency of the centrifugal blower by increasing the exist velocity of the discharge air, increasing the noise generated by the centrifugal blowers, and decreasing the uniformity of the flow of discharge air at the outlet.

BRIEF DESCRIPTION

In one aspect, a centrifugal blower assembly is provided. The centrifugal blower assembly includes a scroll wall, a pair of opposing sidewalls, and an adjustable cutoff plate. The scroll wall is positioned between the pair of opposing sidewalls such that the scroll wall and opposing sidewalls together define a blower chamber and a blower outlet. The scroll wall extends circumferentially between a cutoff point to an end point and defines a cutout extending circumferentially from the cutoff point. The scroll wall, the pair of opposing sidewalls, and the cutoff point define a blower outlet. The blower outlet defines a blower outlet area. The adjustable cutoff plate is adjustably positioned within the cutout to define a notch defining a notch area. The notch area and the blower outlet area define a total blower outlet area. The adjustable outlet plate is moveable to a first position to define a first total blower outlet area.

In another aspect, a centrifugal blower assembly is provided. The centrifugal blower assembly includes a scroll wall, a pair of opposing sidewalls, and a cutoff plate. The scroll wall is positioned between the pair of opposing sidewalls such that the scroll wall and opposing sidewalls together define a blower chamber and a blower outlet. The scroll wall extends circumferentially between a cutoff point to an end point and defines a cutout extending circumferentially from the cutoff point. The scroll wall, the pair of opposing sidewalls, and the cutoff point define a blower outlet. The blower outlet defines a blower outlet area. The cutoff plate is permanently positioned within the cutout to define a notch defining a notch area. The notch area and the blower outlet area define a total blower outlet area. The permanent notch includes a center portion including an elliptical shape.

In yet another aspect, a method of assembling a centrifugal blower assembly is provided. The method comprises coupling a scroll wall between a pair of opposing side walls to define a blower chamber and a blower outlet. The scroll wall includes a cutout. The method also includes adjustably positioning an adjustable cutoff plate within the cutout to define a notch defining a notch area. The notch area and the blower outlet area define a total blower outlet area. The adjustable outlet plate is moveable to a first position to define a first total blower outlet area.

DETAILED DESCRIPTION

Figure 1:
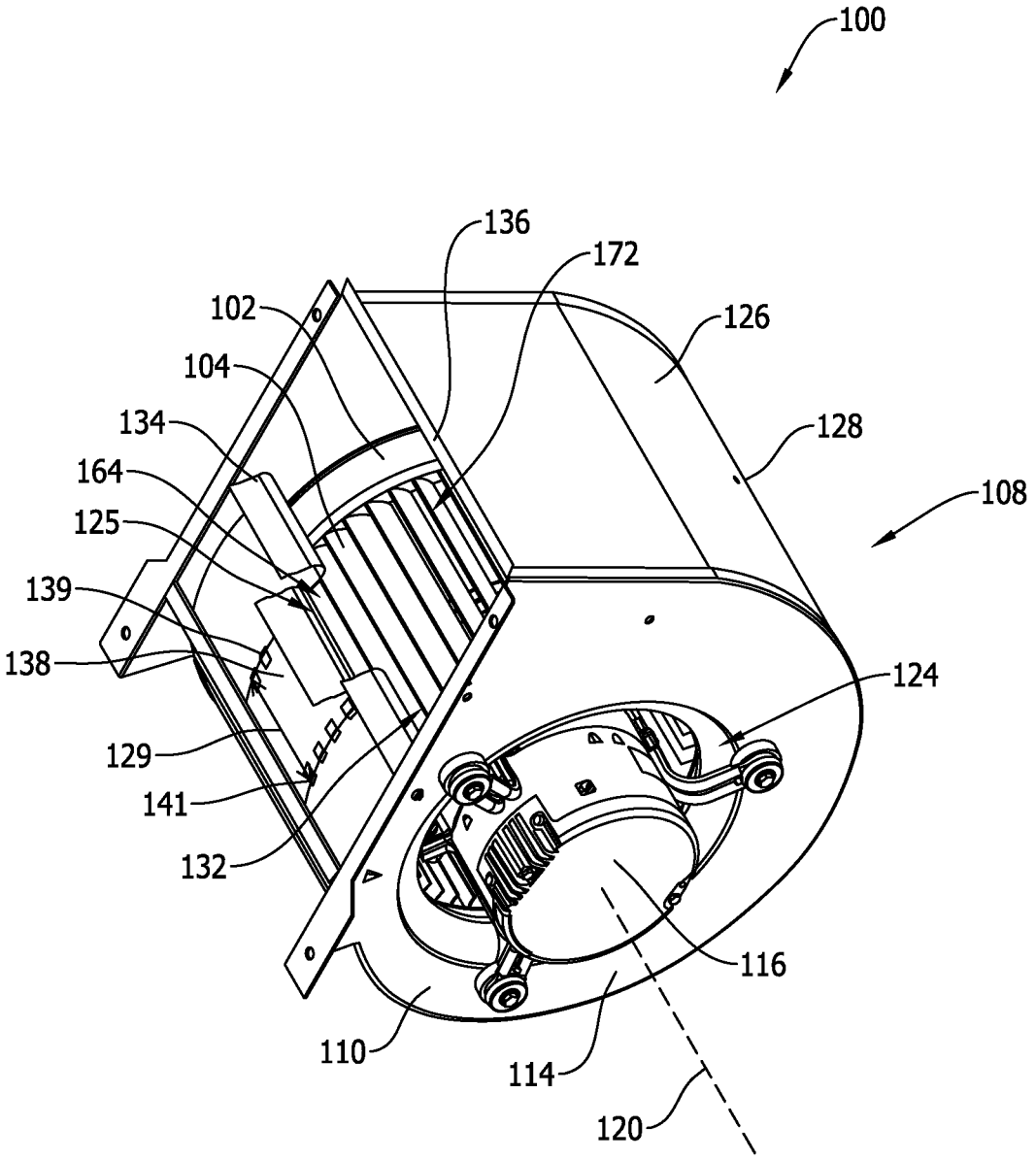
FIG. 1 is a perspective view of an exemplary blower assembly.
Figure 2:
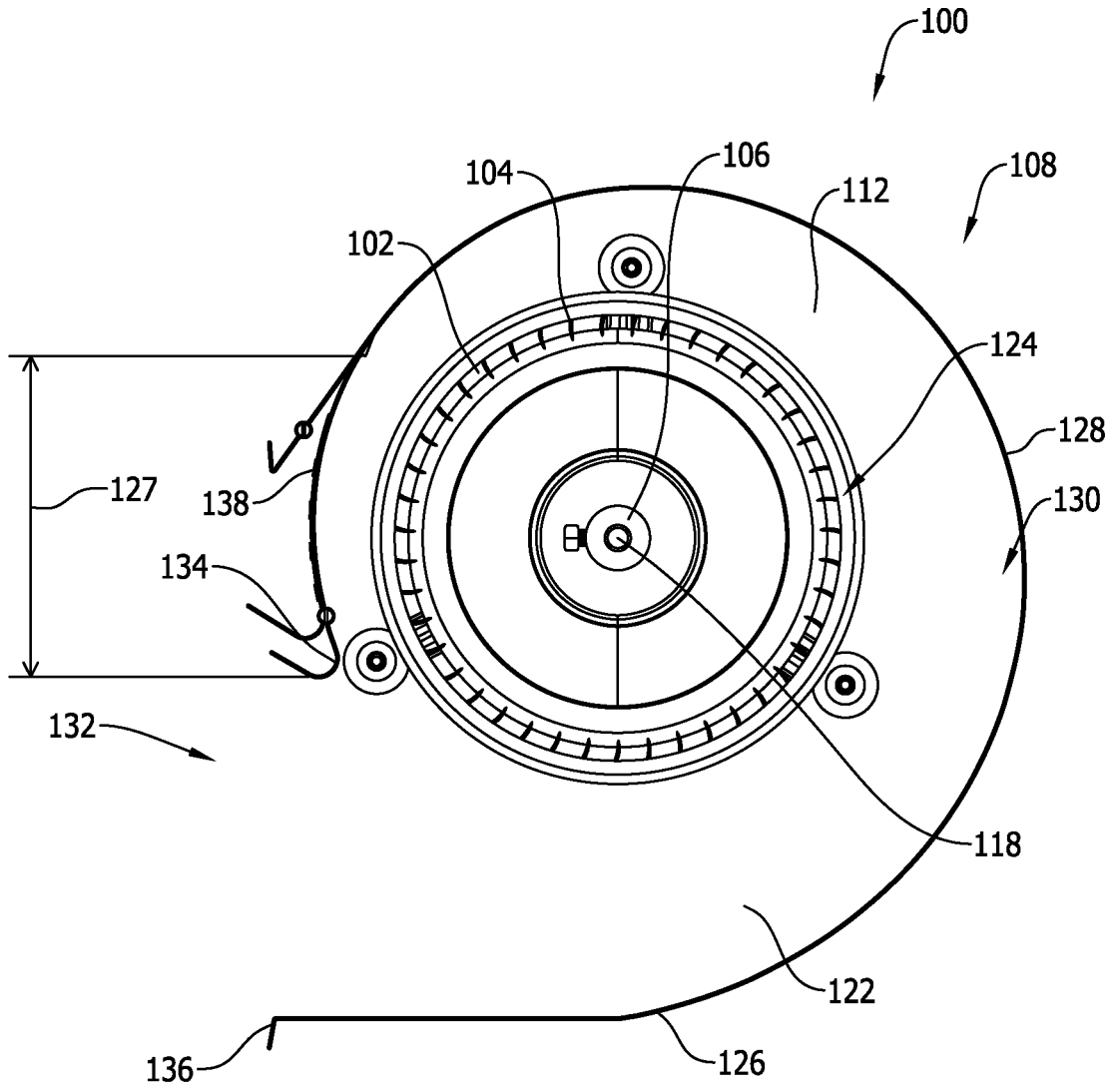
FIG. 2 is a right side view of the blower assembly shown in FIG. 1 with a right side panel removed.
Figure 3:
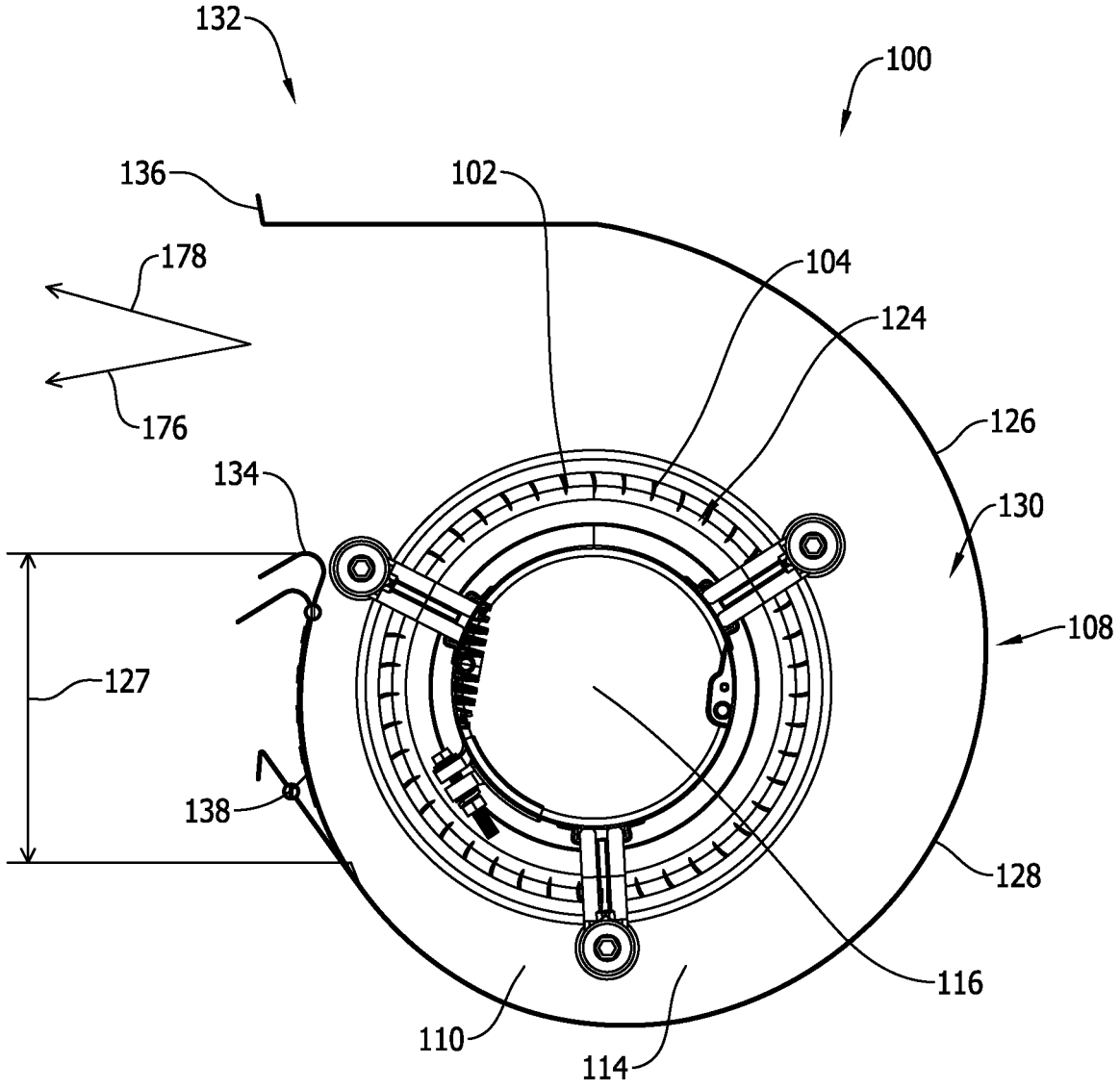
FIG. 3 is a left side view of the blower assembly shown in FIG. 1 with a left side panel removed.
Figure 4:
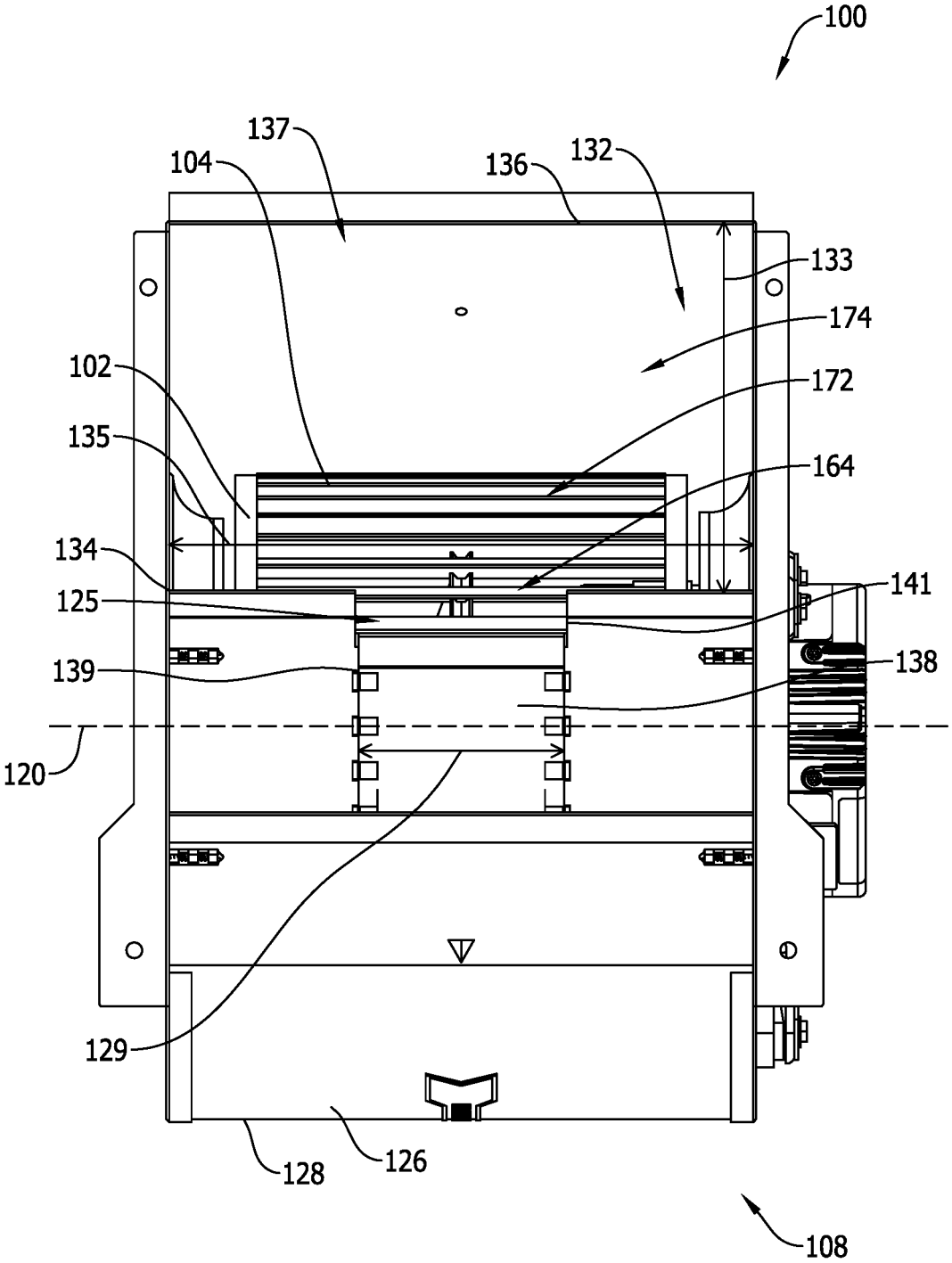
FIG. 4 is a front view of the blower assembly shown in FIG. 1.

The embodiments described herein relate to a centrifugal fan housing. More specifically, embodiments relate to a centrifugal fan housing including a cutoff that is adjustable or a fixed cutoff with aerodynamic and acoustic geometries. FIG. 1 illustrates an exemplary embodiment of a centrifugal blower assembly 100. FIG. 2 is a right side view of centrifugal blower assembly 100 shown in FIG. 1 with a right side panel removed. FIG. 3 is a left side view of centrifugal blower assembly 100 shown in FIG. 1 with a left side panel removed. FIG. 4 is a front view of centrifugal blower assembly 100 shown in FIG. 1. Blower assembly 100 includes at least one wheel 102 that includes a plurality of fan blades 104 positioned circumferentially about wheel 102. Wheel 102 is further coupled to a wheel hub 106. Blower 100 further includes a housing 108 comprising a rear portion 110 and a front portion 112. Rear portion 110 includes a sidewall 114 through which a motor 116 is inserted. Motor 116 includes a shaft 118 that engages hub 106 to facilitate rotation of wheel 102 about an axis 120. Front portion 112 of housing 108 also includes a sidewall 122. Sidewalls 114 and 122 include an inlet 124 through which a volume of air is drawn by wheel 102 to provide air to blower assembly 100. Moreover, blower 100 includes a scroll wall 126 defining a blower circumference 128 and is positioned between sidewall 114 and sidewall 122. Scroll wall 126 extends circumferentially from a cutoff point 134 about a blower chamber 130 to a scroll wall end point 136 and covers a portion of blower circumference 128.

Scroll wall 126 is positioned progressively further from wheel 102 in the direction of rotation to accommodate the growing volume of air due to the scroll shape of chamber 130. Rotation of wheel 102 facilitates drawing air through inlet 124, passing it around blower chamber 130, and exhausting it through an outlet 132. In the exemplary embodiment, blower assembly 100 includes a single wheel 102 and inlet 124, alternatively, blower assembly 100 may include more than one wheel and/or inlet. In the exemplary embodiment, scroll wall 126 includes a cutout 125 extending circumferentially from cutoff point 134. Cutout 125 includes a length 127 and a width 129. Cutout 125 includes two sides 139 and 141 and a bottom 143.

In the exemplary embodiment, an adjustable cutoff plate 138 is positioned within cutout 125. As such, adjustable cutoff plate 138, sidewall 114, sidewall 122, and scroll wall 126 together define blower chamber 130 and outlet 132 through which an air stream is exhausted downstream of blower assembly 100. As shown in FIG. 4, outlet 132 includes a height 133 and a width 135 which define an outlet area 137. Although blower assembly 100 is illustrated as having only one inlet, outlet, and wheel, blower assembly 100 may include any number of inlets, outlets, and wheels.

Figure 5:
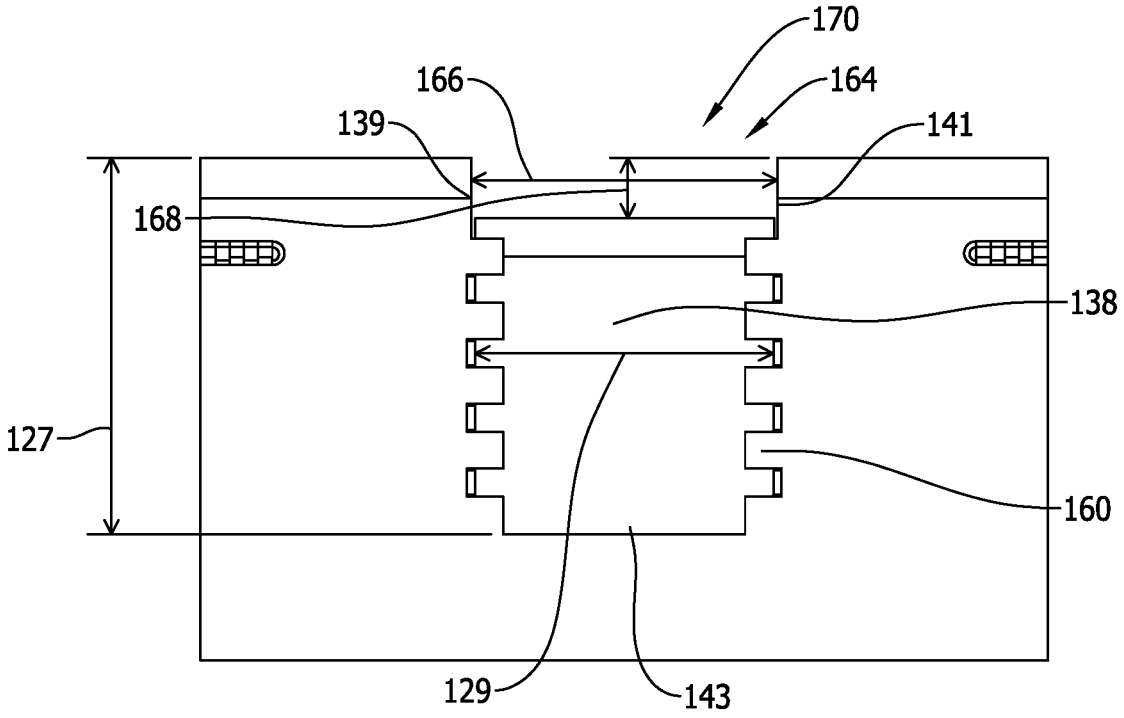
FIG. 5 is a front view of a portion of scroll wall with an adjustable cutoff plate positioned within a cutout.
Figure 6:
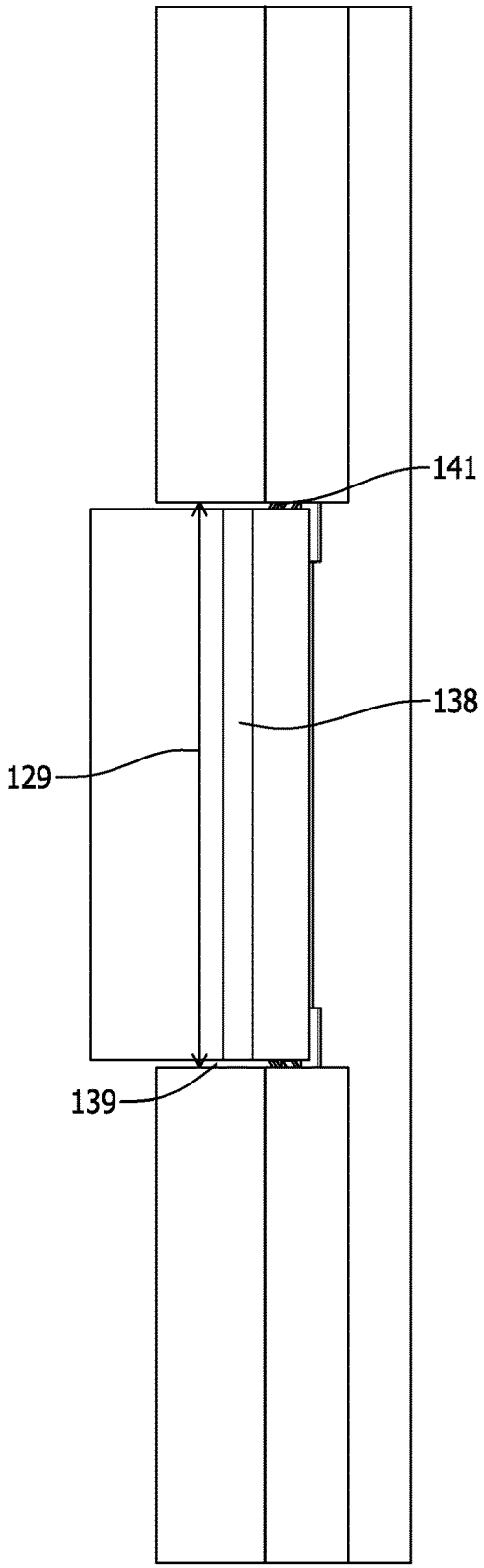
FIG. 6 is a top view of the portion of scroll wall shown in FIG. 5 with the adjustable cutoff plate positioned within the cutout.
Figure 7:
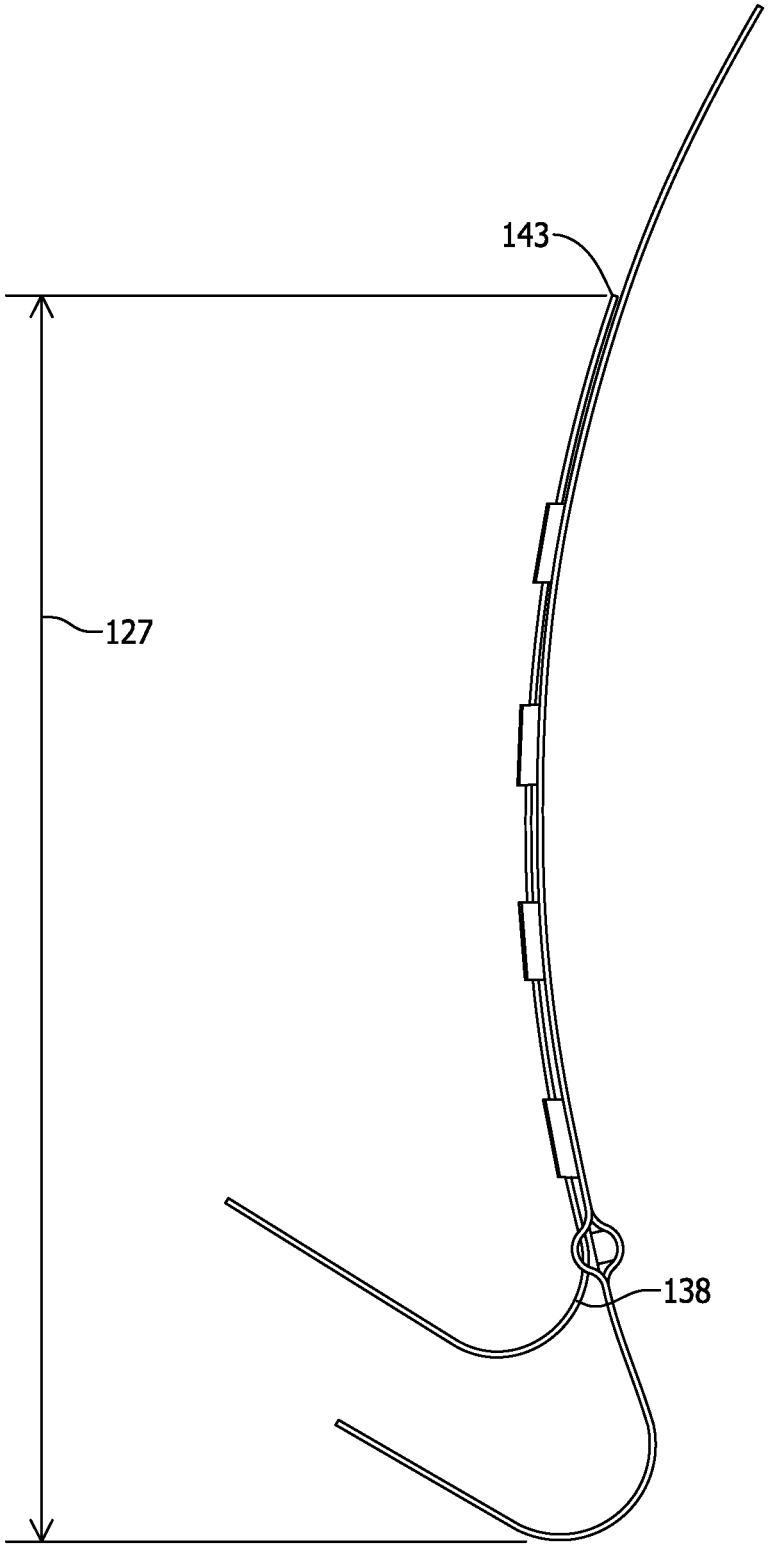
FIG. 7 is a side view of the portion of scroll wall shown in FIG. 5 with the adjustable cutoff plate positioned within the cutout.
Figure 8:
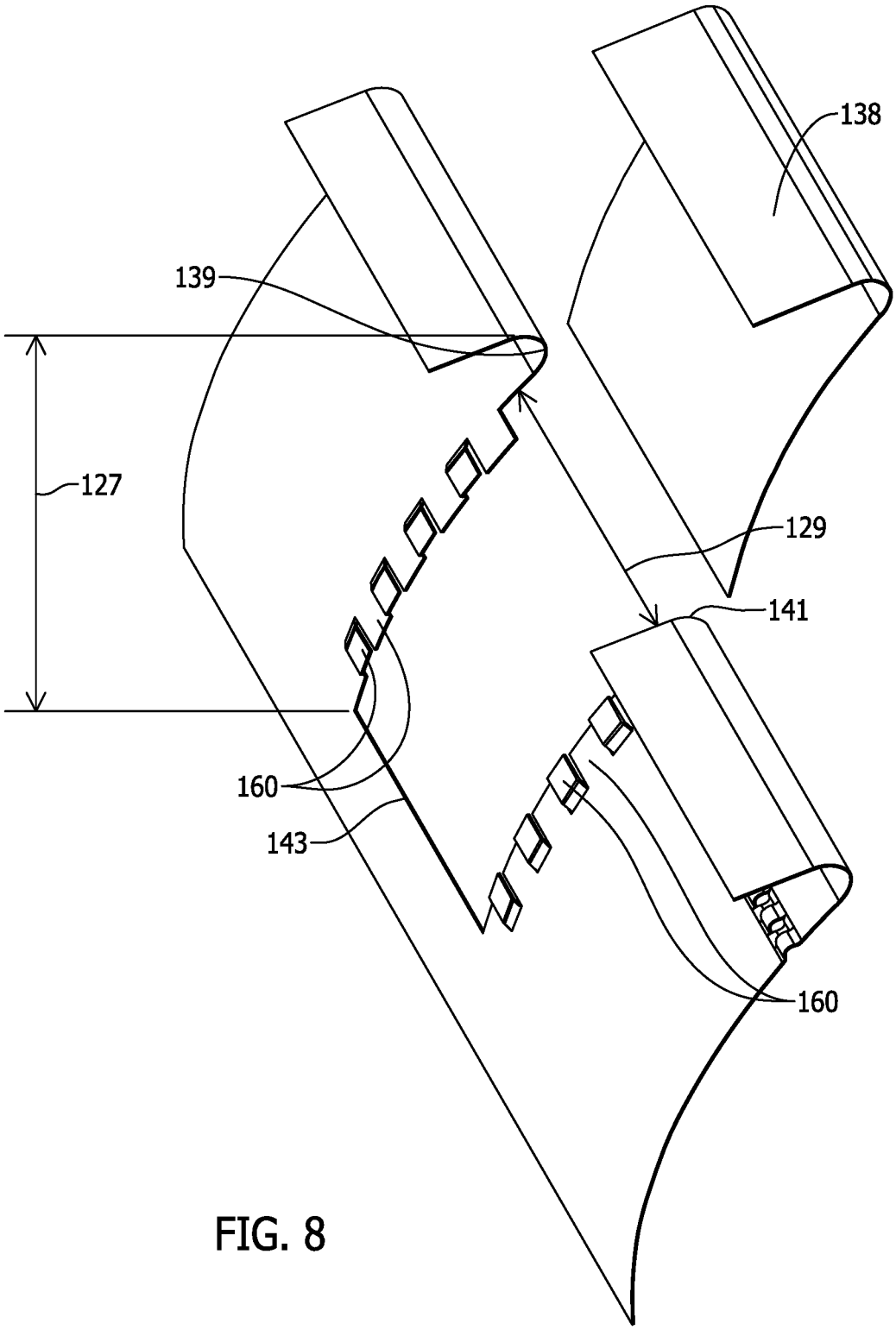
FIG. 8 is a perspective view of the portion of scroll wall shown in FIG. 5 with the adjustable cutoff plate positioned outside of the cutout.
Figure 9:
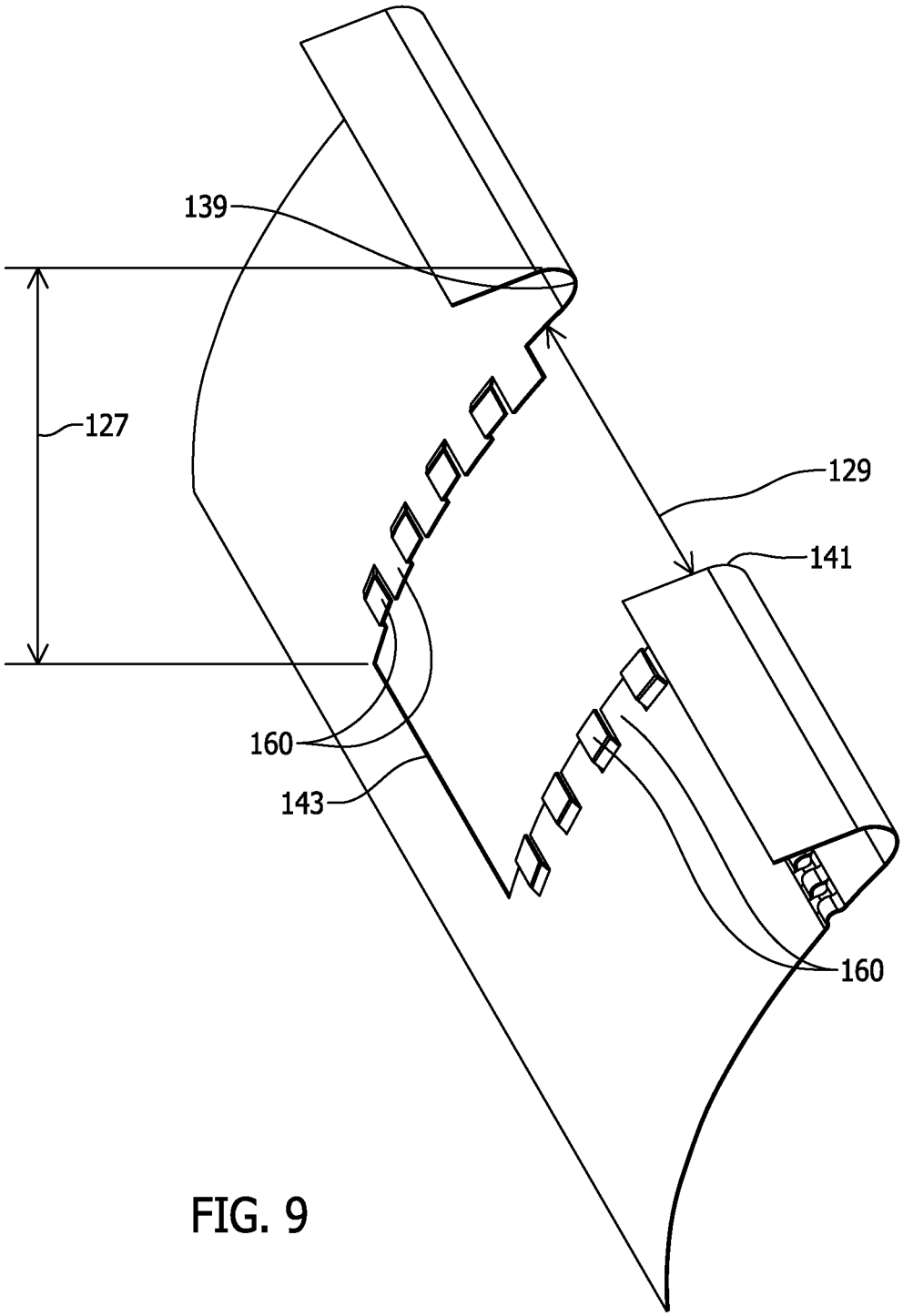
FIG. 9 is a perspective view of the portion of scroll wall shown in FIG. 5.
Figure 10:
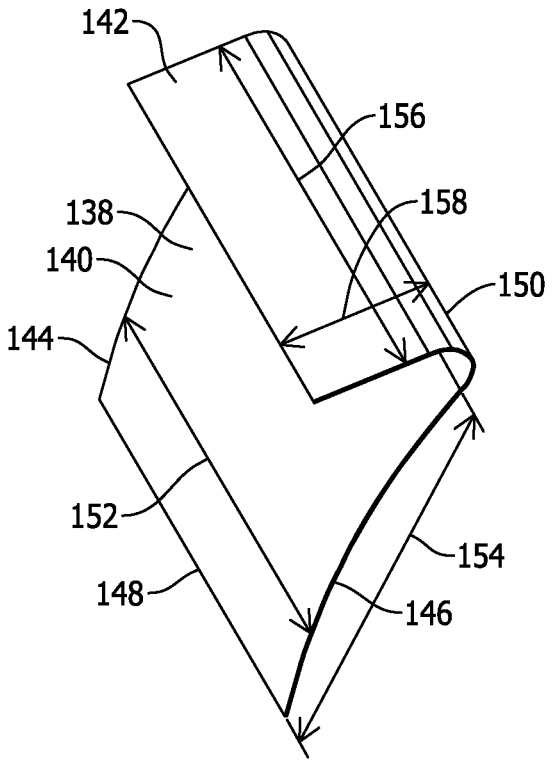
FIG. 10 is a perspective view of the adjustable cutoff plate shown in FIG. 5.

FIG. 5 is a front view of a portion of scroll wall with an adjustable cutoff plate positioned within a cutout. FIG. 6 is a top view of the portion of scroll wall shown in FIG. 5 with the adjustable cutoff plate positioned within the cutout. FIG. 7 is a side view of the portion of scroll wall shown in FIG. 5 with the adjustable cutoff plate positioned within the cutout. FIG. 8 is a perspective view of the portion of scroll wall shown in FIG. 5 with the adjustable cutoff plate positioned outside of the cutout. FIG. 9 is a perspective view of the portion of scroll wall shown in FIG. 5. FIG. 10 is a perspective view of the adjustable cutoff plate shown in FIG. 5. Adjustable cutoff plate 138 includes a scroll wall plate 140 and an outlet lip 142. Scroll wall plate 140 includes two side edges 144 and 146, a back edge 148, and a front edge 150. Scroll wall plate 140 also includes a width 152 and a height 154. Outlet lip 142 extends from front edge 150 and includes a width 156 and a length 158. Outlet lip 142 configured to direct the flow through the outlet 132 to an appliance to prevent sudden expansion between blower assembly 100 and the appliance.

In the exemplary embodiment, cutout 125 has length 127 of approximately 3.5 inches to approximately 5.5 inches and width 129 of approximately 3 inches to approximately 5 inches. Alternatively, cutout 125 may have any length 127 and width 129 that enables blower assembly 100 to function as described herein.

In the exemplary embodiment, scroll wall plate 140 has height 154 of approximately 3.3 inches to approximately 5.3 inches and width 152 of approximately 2.9 inches to approximately 4.9 inches. Alternatively, scroll wall plate 140 may have any height 154 and width 152 that enables blower assembly 100 to function as described herein. Scroll wall plate 140 width 152 is less than outlet 132 width 135 such that adjustable cutoff plate 138 extends between sidewalls 114 and 122.

In the exemplary embodiment, outlet lip 142 has length 158 of approximately 1 inches to approximately 1.8 inches and width 156 of approximately 2.9 inches to approximately 4.9 inches. Alternatively, outlet lip 142 may have any length 158 and width 156 that enables blower assembly 100 to function as described herein. In the exemplary embodiment, outlet lip 142 width 156 is equal to scroll wall plate 140 width 152.

In the exemplary embodiment, outlet 132 has height 133 of approximately 6.6 inches to approximately 8.6 inches and width 135 of approximately 6.5 inches to approximately 13.5 inches. Alternatively, outlet 132 may have any height 133 and width 135 that enables blower assembly 100 to function as described herein.

In the exemplary embodiment, outlet 132 has outlet area 137 of approximately 43 square inches to approximately 116 square inches. Alternatively, outlet 132 may have any outlet area 137 that enables blower assembly 100 to function as described herein.

Cutout 125 includes a plurality of tabs 160 extending from sides 139 and 141. Tabs 160 extend above and below adjustable cutoff plate 138 such that adjustable cutoff plate 138 slides in between tabs 160 and into a predetermined position within cutout 125. Tabs 160 are configured to maintain adjustable cutoff plate 138 in the predetermined position while adjustable cutoff plate 138 is permanently positioned within cutout 125. In the exemplary embodiment, adjustable cutoff plate 138 is permanently positioned within cutoff 125 by a plurality of spot welds on each tab 160 that permanently maintains adjustable cutoff plate 138 in the predetermined position. Alternatively, adjustable cutoff plate 138 may be permanently positioned within cutoff 125 by a plurality of screws, bolts, or other fasteners on each tab 160 that permanently maintains adjustable cutoff plate 138 in the predetermined position. Alternatively, adjustable cutoff plate 138 may be permanently positioned within cutoff 125 using any method that enables blower assembly 100 to function as described herein.

Prior to operation of blower assembly 100, adjustable cutoff plate 138 is positioned in the predetermined position within cutout 125 by sliding adjustable cutoff plate 138 between tabs 160. Tabs 160 temporarily maintain adjustable cutoff plate 138 in the predetermined position while adjustable cutoff plate 138 is permanently positioned within cutout 125 by permanently fastening adjustable cutoff plate 138 to tabs 160 creating a notch 164 within scroll wall 126.

Notch 164 extends from outlet lip 142 to cutoff point 134 and includes a width 166 and a length 168. In the exemplary embodiment, notch 164 has length 168 of approximately 0 inches to approximately 2 inches and width 166 of approximately 3 inches to approximately 5 inches. Alternatively, notch 164 may have any length 168 and width 166 that enables blower assembly 100 to function as described herein. Length 168 is dependent on the position of adjustable cutoff plate 138. Length 168 and width 166 together define a notch area 170 of approximately 0 square inches to approximately 10 square inches. Adjusting length 168 adjusts notch area 170. As such, notch area 170 may have any area that enables blower assembly 100 to function as described herein.

Notch 164 and outlet 132 together define a total blower outlet 172. Total blower outlet 172 has a total blower outlet area 174 defined by notch area 170 and outlet area 137. Adjusting length 168 adjusts notch area 170 and total blower outlet area 174. That is, increasing length 168 by sliding adjustable cutoff plate 138 circumferentially away from cutoff point 134 increases notch area 170 and total blower outlet area 174. Conversely, decreasing length 168, by sliding adjustable cutoff plate 138 circumferentially toward cutoff point 134, decreases notch area 170 and total blower outlet area 174.

In the exemplary embodiment, total blower outlet 172 has total blower outlet area 174 of approximately 45 square inches to approximately 122 square inches. Alternatively, total blower outlet 172 may have any total blower outlet area 174 that enables blower assembly 100 to function as described herein.

Adjusting total blower outlet area 174 allows the discharge air to be directed in different directions. Sliding adjustable cutoff plate 138 circumferentially away from cutoff point 134 increases notch area 170 and total blower outlet area 174 and directs a portion of discharge air in a direction 176 as shown in FIG. 3. Sliding adjustable cutoff plate 138 circumferentially toward cutoff point 134 decreases notch area 170 and total blower outlet area 174 and directs a portion of discharge air in direction 178 as shown in FIG. 3. Direction 176 is at an angle relative to direction 178 and, as such, the flow of discharge air from a larger total blower outlet area 174 is more spread out than the flow of discharge air from a smaller total blower outlet area 174.

Additionally, as previously discussed, adjusting length 168 also adjusts total blower outlet area 174, which adjusts the outlet velocity of discharge air from blower assembly 100. Sliding adjustable cutoff plate 138 circumferentially toward cutoff point 134 decreases notch area 170 and total blower outlet area 174 and increases the outlet velocity of discharge air from blower assembly 100. Alternatively, sliding adjustable cutoff plate 138 circumferentially away from cutoff point 134 increases notch area 170 and total blower outlet area 174 and decreases the outlet velocity of discharge air from blower assembly 100. Adjusting the outlet velocity of discharge air tunes the heat transfer and pressure drops in downstream equipment. As such, adjusting length 168 tunes the outlet velocity of discharge air from blower assembly 100, which tunes the heat transfer rates and pressure drop in downstream heat exchanging equipment, such as HVAC equipment. To avoid sudden expansion and its corresponding pressure losses, blower assembly 100 provides the flexibility to tune total blower outlet area 174 to different discharge duct sizes while maintaining the optimal performance of blower assembly 100.

Figure 11:
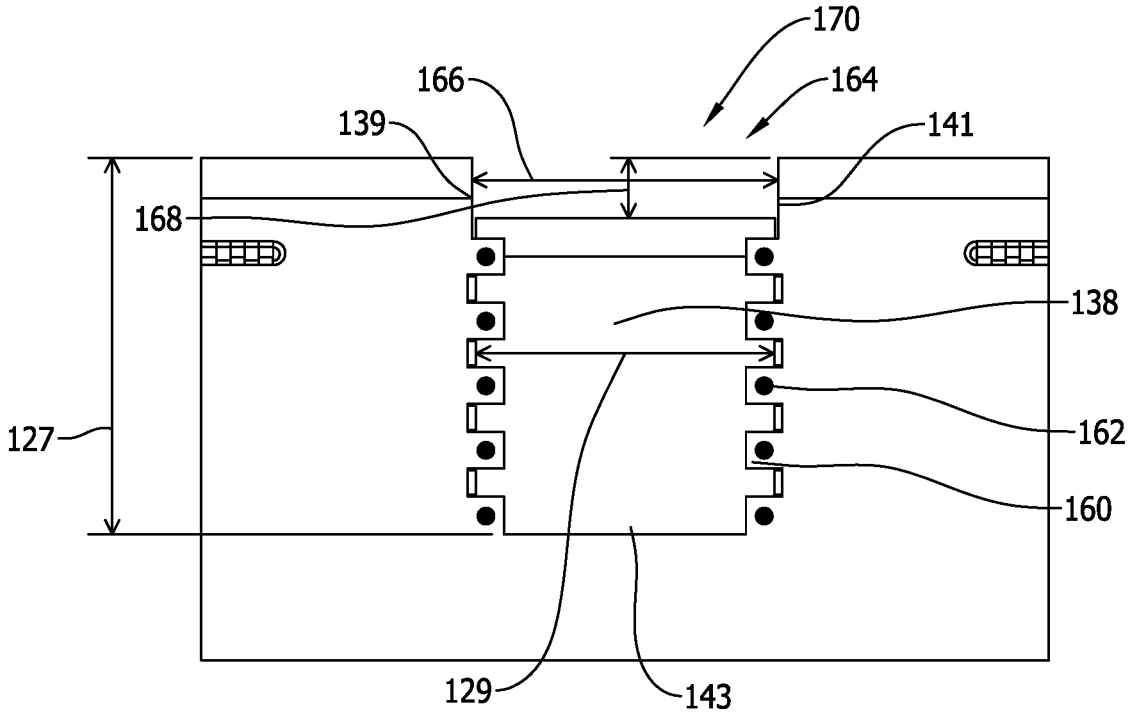
FIG. 11 is a perspective view of a portion of an alternative scroll wall with an adjustable cutoff plate positioned within a cutout.

In an alternative embodiment, tabs 160 are configured to maintain adjustable cutoff plate 138 in the predetermined position while a plurality of fasteners 162 are coupled to tabs 160 and adjustable cutoff plate 138. FIG. 11 is a front view of a portion of scroll wall with adjustable cutoff plate positioned within cutout by fasteners 162. In the illustrated embodiment, fasteners 162 may include screws or bolts that extend through tabs 160 and adjustable cutoff plate 138 to maintain adjustable cutoff plate 138 in the predetermined position. Alternatively, fasteners 162 may include any fastener that enables blower assembly 100 to function as described herein. Screws or bolts do not permanently position adjustable cutoff plate 138 the predetermined position because the screws or bolts can be removed and the position of adjustable cutoff plate 138 can be adjusted. As such, adjustable cutoff plate 138 is capable of being adjusted to multiple predetermined positions. During a first operational mode, adjustable cutoff plate 138 is positioned in a first predetermined position. During a second operational mode, adjustable cutoff plate 138 is repositioned in a second predetermined position. In order to change from the first predetermined position to the second predetermined position, fasteners 162 (screws or bolts) are removed from tabs 160 and adjustable cutoff plate 138. Adjustable cutoff plate 138 is then repositioned to the second predetermined position. Fasteners 162 (screws or bolts) are then reinserted into tabs 160 and adjustable cutoff plate 138 to maintain adjustable cutoff plate 138 in the second predetermined position during the second operational mode. Adjustably positioning adjustable cutoff plate 138 within cutoff 125 allows total blower outlet area 174 to be tuned to changing operational conditions.

Figure 12:
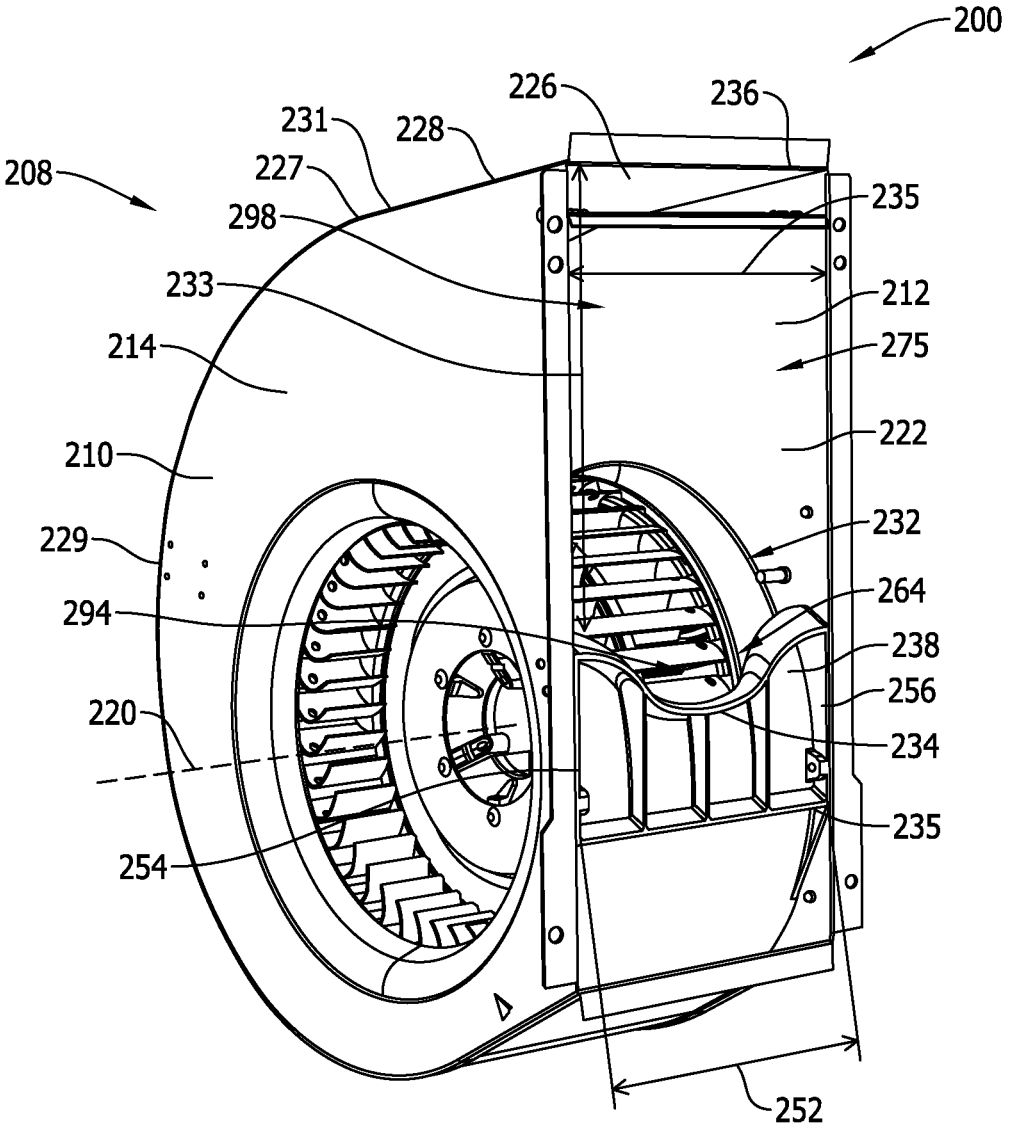
FIG. 12 is a perspective view of an alternative blower assembly.
Figure 13:
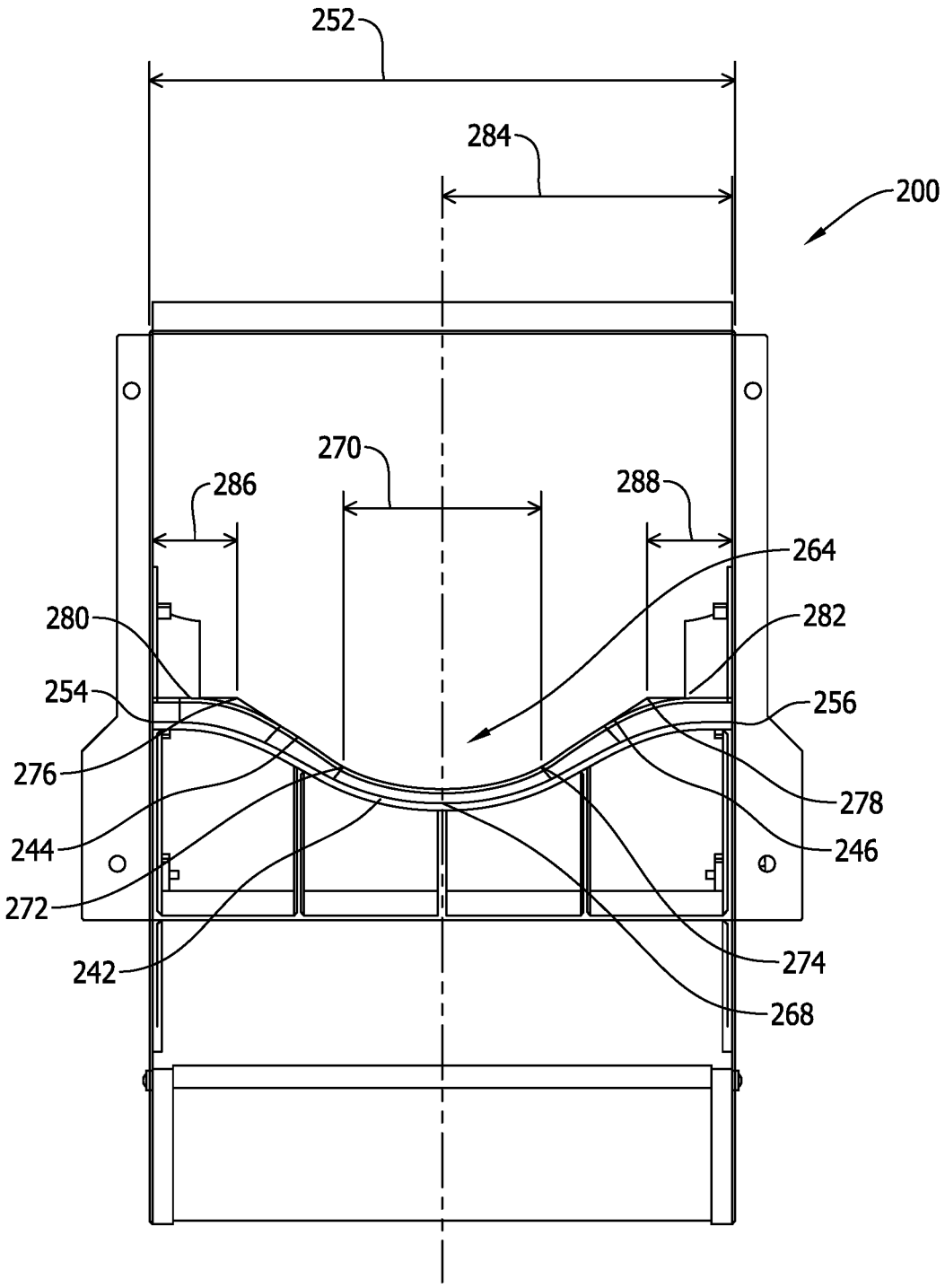
FIG. 13 is a front view of the blower assembly shown in FIG. 12.
Figure 14:
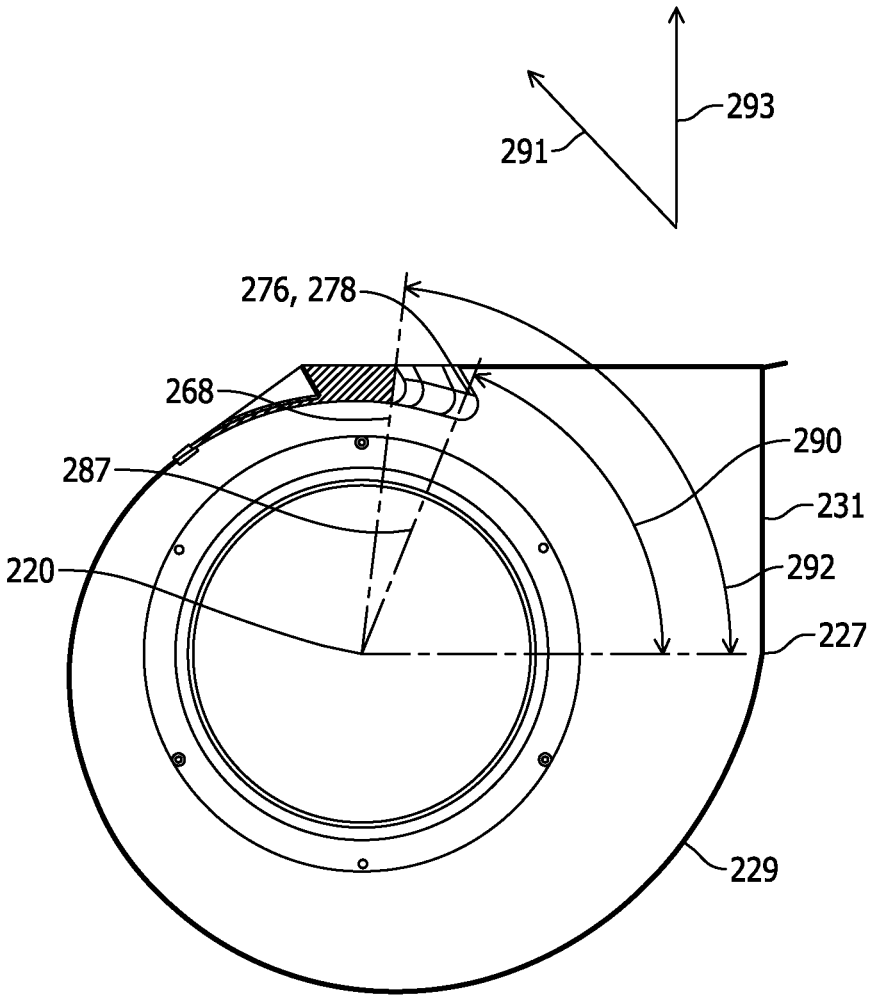
FIG. 14 is a sectional side view of blower assembly shown in FIG. 12.

FIGS. 12-14 illustrate alternative embodiments of blower assembly 100. Like components will be given like reference numerals for ease of understanding. FIG. 12 is a perspective view of an alternative blower assembly 200. FIG. 13 is a front view of blower assembly 200 shown in FIG. 12. FIG. 14 is a sectional side view of blower assembly 200 shown in FIG. 12. Blower assembly 200 includes a housing 208 comprising a rear portion 210 and a front portion 212. Rear portion 210 includes a sidewall 214 and front portion 212 of housing 208 also includes a sidewall 222. Moreover, blower assembly 200 includes a scroll wall 226 positioned between sidewall 214 and sidewall 222 and defining a blower circumference 228. Scroll wall 226 extends circumferentially about housing chamber 230 from a first scroll wall end point 235 to a second scroll wall end point 236 and includes a curve transition point 227 which separates scroll wall 226 into a scroll wall curved portion 229 and a scroll wall flat portion 231. A cutoff plate 238 extends from first scroll wall end point 235 to a cutoff point 234 and includes, a first side 254, a second side 256, and a width 252 extend between first and second side 254 and 256. Sidewalls 214 and 222, cutoff plate 238, and scroll wall 226 define an outlet 232 including a height 233 and a width 235 which define an outlet area 275.

Rather than including adjustable cutoff plate 138 as shown in FIGS. 1-11, blower assembly 200 includes cutoff plate 238 which includes a permanent notch 264. Notch 264 reduces pressure drop from blower assembly 200, decreases noise from blower assembly 200, and increases the efficiency of blower assembly 200. In the exemplary embodiment, notch 264 includes a curved cutout in a center portion 242 of cutoff plate 238 and two sloped side portions 244 and 246 adjacent center portion 242. In the exemplary embodiment, the curved cutout follows the shape of a portion of an ellipse when a major axis of the ellipse is oriented perpendicular to sidewalls 214 and 222 and a minor axis of the ellipse is oriented perpendicular to scroll wall end point 236. Alternatively, notch 264 may have any shape that enables blower assembly 200 to operate as described herein.

Notch 264 includes a center point 268 and center portion 242 including a center width 270 extending between a first point 272 and a second point 274. Notch 264 also includes a first sloped portion 244 and a second sloped portion 246. First sloped portion 244 extends between first point 272 and a third point 276. Second sloped portion 246 extends between second point 274 and a fourth point 278. Notch 264 is positioned between two flat portions 280 and 282. A first flat portion 280 extends between third point 276 and first side 254 of cutoff plate 238. A second flat portion 282 extends between fourth point 278 and second side 256 of cutoff plate 238. Cutoff plate 238 includes a half width 284 extending from either first or second side 254 or 256 to center point 268. First flat portion 280 includes a first flat portion width 286 and second flat portion 282 includes a second flat portion width 288. In the exemplary embodiment, first flat portion width 286 and second flat portion width 288 are equal in length and will be referred to as flat portion length 286 and 288. In another embodiment, first flat portion width 286 and second flat portion width 288 may have different lengths.

In the exemplary embodiment, center portion 242 includes an elliptical shape that includes a curved transition to first and second sloped portions 244 and 246 at first and second points 272 and 274. Additionally, first and second sloped portions 244 and 246 each include a curved transition to first and second flat portions 280 and 282 at third and fourth points 276 and 278. Thus, notch 264 includes a curved profile that seamlessly transitions from flat portions 280 and 282 to sloped portions 244 and 246 and from sloped portions 244 and 246 to center portion 242.

As shown in FIG. 14, a first angle 290 extends from either third or fourth points 276 and 278 to curve transition point 227 about an axis 220. A second angle 292 extends from center points 268 to curve transition point 227 about axis 220. In the exemplary embodiment, first angle 290 is approximately 55 degrees to approximately 75 degrees and second angle 292 is approximately 65 degrees to approximately 90 degrees. As such, the difference between first angle 290 and second angle 292 is approximately 10 degrees to approximately 15 degrees. Additionally, a cutoff radius 287 extends from axis 220 to either third or fourth points 276 and 278 and has a cutoff radius length 289.

A flat portion ratio is the ratio of flat portion length 286 and 288 to half width 284. Flat portion ratio indicates how wide notch 264 is relative to width 252. If flat portion ratio is 1, then flat portion length 286 and 288 is equal to half width 284 and cutoff plate 238 does not include notch 264. Additionally, if flat portion ratio is 1, first angle 290 and second angle 292 are equal and both first angle 290 and second angle 292 extend from either third or fourth points 276 and 278 to curve transition point 227. If flat portion ratio is 0, then flat portion length 286 and 288 is 0 and cutoff plate 238 does not include first and second flat portions 280 and 282. In the exemplary embodiment, flat portion ratio is approximately 1 to approximately 0. Additionally, if flat portion ratio is 0, first angle 290 and second angle 292 are equal and both first angle 290 and second angle 292 extend from center points 268 to curve transition point 227.

Notch 264 defines a notch area 294 of approximately 0 square inches to approximately 10 square inches. However, notch area 294 may have any area that enables blower assembly 200 to function as described herein. Notch 264 and outlet 232 together define a total blower outlet 296. Total blower outlet 296 has a total blower outlet area 298 defined by notch area 294 and outlet area 275. Notch 264 increases outlet area 275 to total blower outlet area 298 by adding notch area 294.

In the exemplary embodiment, total blower outlet 296 has total blower outlet area 298 of approximately 45 square inches to approximately 122 square inches. Alternatively, total blower outlet 296 may have any total blower outlet area 298 that enables blower assembly 200 to function as described herein.

Notch 264 allows the discharge air to be directed in different directions. Specifically, notch 264 allows a portion of the discharge air to be directed in a direction 291 as shown in FIG. 14. However, discharge air would normally be directed in direction 293 without notch 264 as shown in FIG. 14. Direction 291 is at an angle relative to direction 293 and, as such, the flow of discharge air from a larger total blower outlet area 298 is more spread out than the flow of discharge air from a smaller outlet area 275.

Additionally, notch 264 decreases the outlet velocity of discharge air from blower assembly 200. Notch 264 increases outlet area 275 by notch area 294 and decreases the outlet velocity of discharge air from blower assembly 200. Decreasing the outlet velocity of discharge air may decrease pressure drops in downstream equipment and may increase the efficiency of blower assembly 200. Additionally, notch 264 avoids sudden expansion into a receiving duct, such as an HVAC duct, and its corresponding pressure losses, and increases the efficiency of blower assembly 200.

Flat portions 280 and 282 reduce backflow of discharge air into outlet 232 proximate to first side 254 and second side 256 and increases the efficiency of blower assembly 200. Decreasing backflow around flat portions 280 and 282 also decreases the blade passing noise and the tonal noise caused by the rapid passing of fan blades 104 in close proximity to cutoff 234.

Figure 15A:
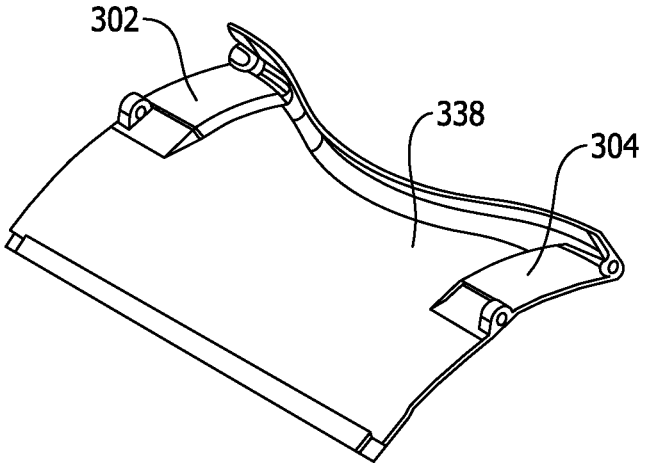
FIG. 15A shows a perspective view of an alternative cutoff plate.
Figure 15B:
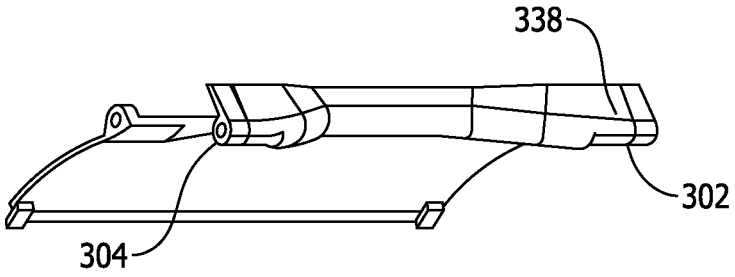
FIG. 15B shows another perspective view of the cutoff plate shown in FIG. 15A.
Figure 15C:
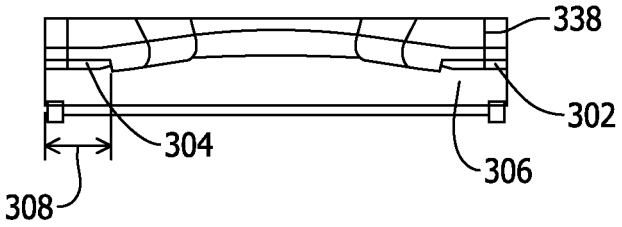
FIG. 15C shows a top view of the cutoff plate shown in FIG. 15A.
Figure 15D:
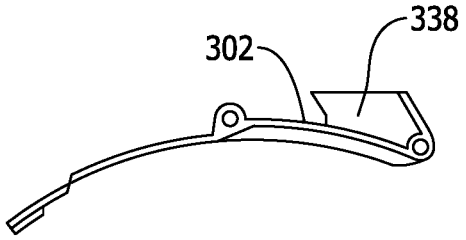
FIG. 15D shows a side view of the cutoff plate shown in FIG. 15A.
Figure 15E:
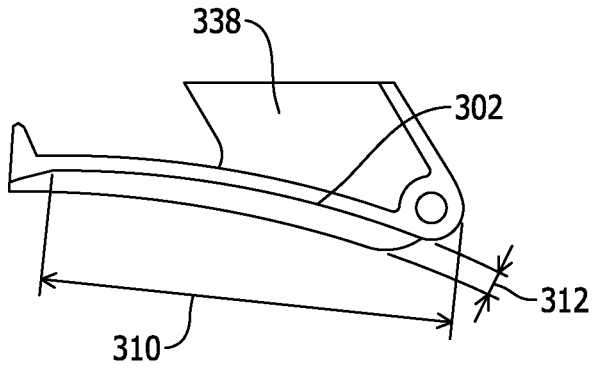
FIG. 15E shows a detail view of the cutoff plate shown in FIG. 15A.
Figure 15F:
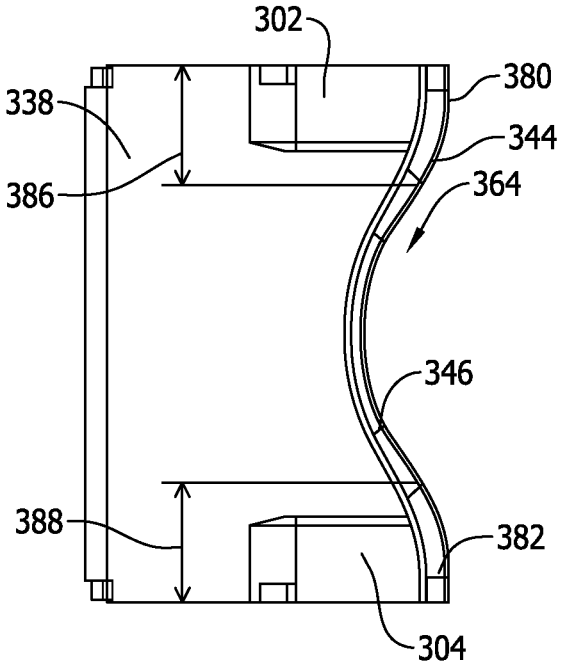
FIG. 15F shows a front view of the cutoff plate shown in FIG. 15A.

FIG. 15A shows a perspective view of cutoff plate 338. FIG. 15B shows another perspective view of cutoff plate 338 shown in FIG. 15A. FIG. 15C shows a top view of cutoff plate 338 shown in FIG. 15A. FIG. 15D shows a side view of cutoff plate 338 shown in FIG. 15A. FIG. 15E shows a detail view of cutoff plate 338 shown in FIG. 15A. FIG. 15F shows a front view of cutoff plate 338 shown in FIG. 15A. Similar to cutoff plate 238, cutoff plate 338 includes a notch 364, a first sloped portion 344, a second sloped portion 346, a first flat portion 380, and a second flat portion 382. First flat portion 380 includes a first flat portion width 386 and second flat portion 382 includes a second flat portion width 388. In the exemplary embodiment, first flat portion width 386 and second flat portion width 388 are equal in length and will be referred to as flat portion width 386 and 388. In another embodiment, first flat portion width 386 and second flat portion width 388 may not be equal. Additionally, first flat portion 380 includes a first flat portion notch 302 and second flat portion 382 includes a second flat portion notch 304. First flat portion notch 302 includes a first flat portion notch width 306 and second flat portion notch 304 includes a second flat portion notch width 308. In the exemplary embodiment, first flat portion notch width 306 and second flat portion notch width 308 are equal in length and will be referred to as flat portion notch width 306 and 308. In another embodiment, first flat portion notch width 306 and second flat portion notch width 308 may not be equal. Flat portion notches 302 and 304 each also include a flat portion notch length 310 and flat portion notch depth 312.

A flat portion notch ratio is the ratio of flat portion notch width 306 and 308 to flat portion width 386 and 388. Flat portion notch ratio indicates how wide flat portion notches 302 and 304 are relative to flat portions 380 and 382. If flat portion notch ratio is 1, then flat portion notch width 306 and 308 is equal to flat portion width 386 and 388 and flat portions 380 and 382 include flat portion notches 302 and 304 that span the entire widths of flat portions 380 and 382. If flat portion ratio is 0, then flat portion notch width 306 and 308 is 0 and flat portions 380 and 382 do not include flat portion notches 302 and 304. In the exemplary embodiment, flat portion notch ratio is approximately 1 to approximately 0.

A cutoff radius ratio is the ratio of flat portion notch depth 312 to cutoff radius length 289. Cutoff radius ratio indicates how deep flat portion notches 302 and 304 are relative to cutoff radius 287. In the exemplary embodiment, cutoff radius ratio is approximately −0.14 to approximately 0.14.

Flat portion notches 302 and 304 increases the volume of discharge air exiting blower assembly 200 at flat portions 380 and 382. The increased volume of discharge air also increases the pressure in the area proximate to flat portions 380 and 382 and decreases the back flow, or air circulating back into outlet 232, into blower assembly 200. Decreasing the backflow into blower assembly 200 increases the efficiency of blower assembly 200 and decreases noise produced by blower assembly 200.

Figure 16A:
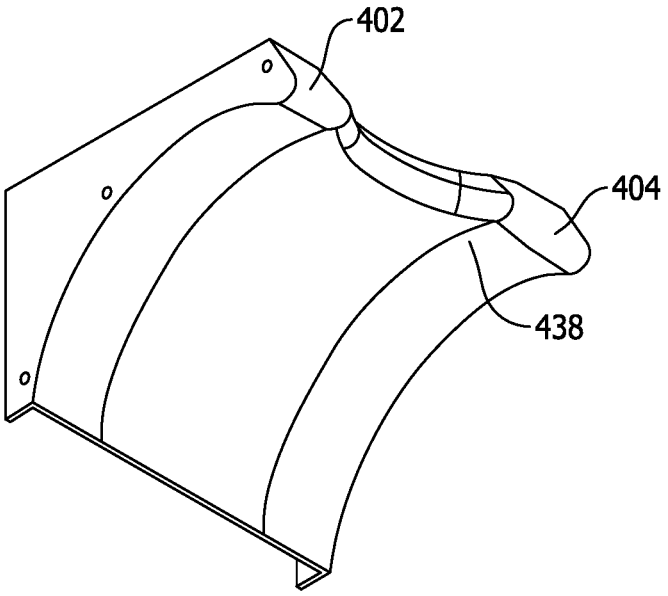
FIG. 16A shows a perspective view of an alternative cutoff plate.
Figure 16B:
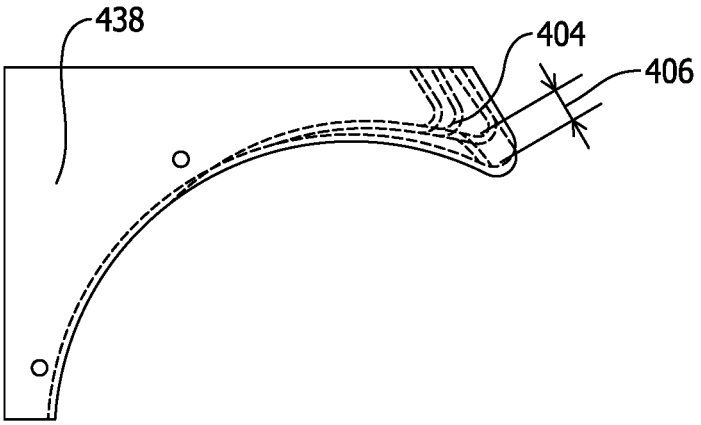
FIG. 16B shows a side view of the cutoff plate shown in FIG. 16A.
Figure 16C:
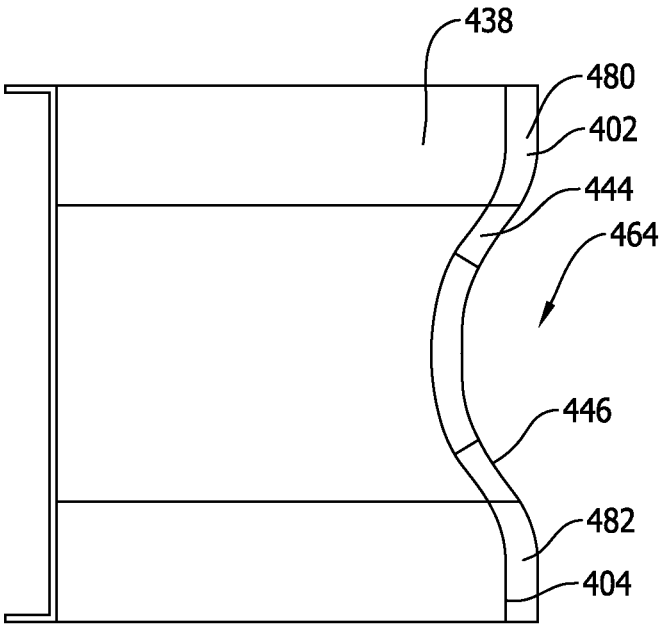
FIG. 16C shows a back view of the cutoff plate shown in FIG. 16A.

FIG. 16A shows a perspective view of cutoff plate 438. FIG. 16B shows a side view of cutoff plate 438 shown in FIG. 16A. FIG. 16C shows a back view of cutoff plate 438 shown in FIG. 16A. Similar to cutoff plate 238, cutoff plate 438 includes a notch 464, a first sloped portion 444, a second sloped portion 446, a first flat portion 480, and a second flat portion 482. First and second flat portions 480 and 482 include end portions 402 and 404 that extend inward toward axis 220. First flat portion 480 includes a first end portion 402 and second flat portion 482 includes a second end portion 404. First end portion 402 and second end portion 404 extend toward axis 220 a length 406. In this embodiment, where the cutoff radius ratio is approximately between −0.14 to 0, the circulating flow in the gap between the fan blade 104 and cutoff 438 decreases which leads to a reduction in inward backflow.

Figure 17:
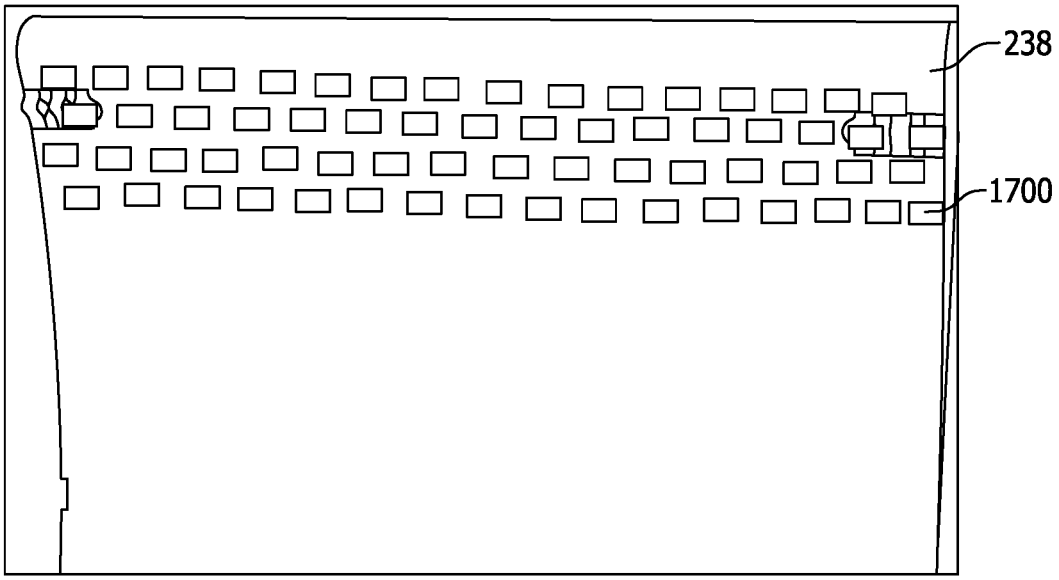
FIG. 17 shows acoustical treatments on a cutoff plate.

In alternative embodiments, cutoff plate 238 includes a plurality of acoustical treatments configured to reduce the blade passing noise and the broad band flow noise caused by the rapid passing of fan blades 104 in close proximity to cutoff 234. FIG. 17 shows a plurality of acoustical treatments 1700 on cutoff plate 238. In the exemplary embodiment, acoustical treatments 1700 include protrusions and/or indentations configured to reduce the blade passing noise and the broad band flow noise caused by the rapid passing of fan blades 104 in close proximity to cutoff 234. This will create dipole pressure fluctuation which cancels the blade 104 passing noises.

Figure 18:
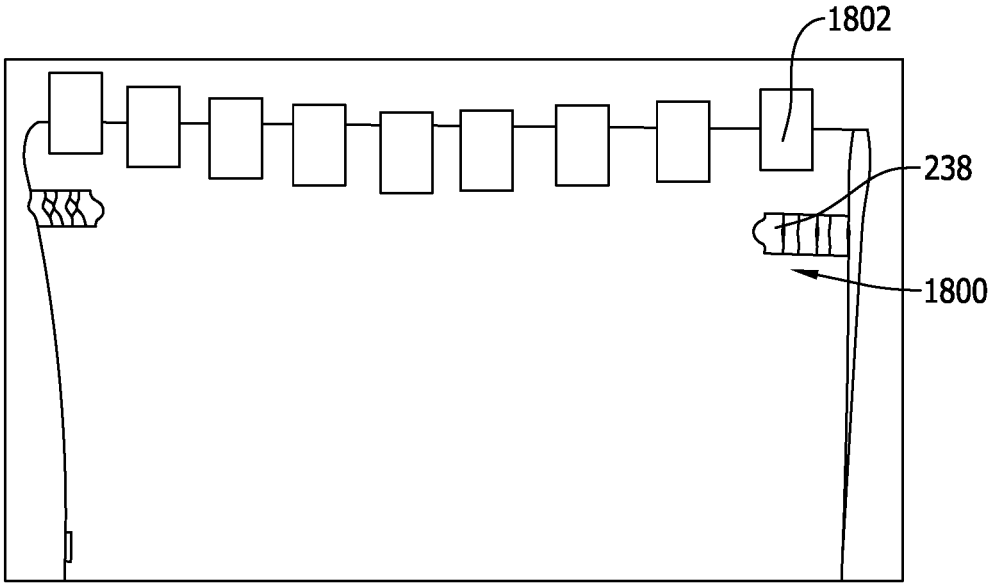
FIG. 18 shows another embodiment of acoustical treatments on a cutoff plate.

FIG. 18 shows a plurality of acoustical treatments 1800 on cutoff plate 238. In the exemplary embodiment, acoustical treatments 1800 include a plurality of phase shift tongues 1802 configured to reduce the blade passing noise and the broad band flow noise caused by the rapid passing of fan blades 104 in close proximity to cutoff 234. The combination of curved geometry of the cutoff 238 and these phase shift tongues 1802 reduces the possibility of the entire length of the fan blade 104 to pass from the entire length of the solid structure of 1800 at the same time. This helps in reducing the noise levels.

The exemplary embodiments of a centrifugal blower assembly described herein include cutoffs that are adjustable or fixed with aerodynamic and acoustic geometries. Generally, optimization of the shape and placement of the centrifugal blower assembly cutoff depends on many factors, such as the size of the blower housing and the of the fan blades within the centrifugal blower assembly. Specifically, adjusting the shape and size of the centrifugal blower assembly outlet by adjusting the shape of the centrifugal blower assembly cutoff reduces pressure drop and decreases noise from the centrifugal blower assembly. To this end, the centrifugal blower assembly includes an adjustable or fixed outlet plate that adjusts the size and shape of centrifugal blower assembly outlet. Additionally, adjusting the centrifugal blower assembly outlet allows the discharge air to be directed in different directions and the heat transfer properties of the discharge air to be tuned for downstream heat transfer equipment. Furthermore, the centrifugal blower assembly cutoff plates may also include acoustic treatments configured to reduce blade passing noise and broad band flow noise.

Exemplary embodiments of a centrifugal blower assembly and a method for assembling the same are described above in detail. The methods and assembly are not limited to the specific embodiments described herein, but rather, components of the assembly and/or steps of the methods may be utilized independently and separately from other components and/or steps described herein. For example, the methods may also be used in combination with other air stream distribution systems and methods, and are not limited to practice with only the assembly and methods as described herein. Rather, the exemplary embodiment can be implemented and utilized in connection with many other air stream distribution applications.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A centrifugal blower assembly comprising:

a scroll wall and a pair of opposing sidewalls, said scroll wall positioned between said pair of opposing sidewalls such that said scroll wall and said pair of opposing sidewalls define a blower chamber, said scroll wall extends circumferentially between a cutoff point to an end point and defines a cutout extending circumferentially from said cutoff point, said scroll wall, said pair of opposing sidewalls, and said cutoff point define a blower outlet, said blower outlet defining a blower outlet area; and a cutoff plate extending circumferentially from said end point, said cutoff plate defines a notch defining a notch area, said notch area and said blower outlet area define a total blower outlet area, wherein said notch includes a center portion that defines a portion of an elliptical shape.

2. The centrifugal blower assembly in accordance with claim 1, wherein said notch includes at least one sloped portion adjacent said center portion.

3. The centrifugal blower assembly in accordance with claim 1, wherein said notch includes two sloped portions each positioned adjacent said center portion.

4. The centrifugal blower assembly in accordance with claim 3 further comprising two flat portions each positioned adjacent at least one of said two sloped portions.

5. The centrifugal blower assembly in accordance with claim 4, wherein said two flat portions each comprise a flat portion notch configured to reduce noise.

6. The centrifugal blower assembly in accordance with claim 1, wherein said cutoff plate includes a plurality of acoustical treatments configured to reduce noise.

7. A method of assembling a centrifugal blower assembly, said method comprising:

coupling a scroll wall between a pair of opposing side walls to define a blower chamber and a blower outlet, the scroll wall extending circumferentially between a cutoff point to an end point and defining a cutout extending circumferentially from the cutoff point;

positioning a cutoff plate to extend circumferentially from the end point, the cutoff plate defining a notch defining a notch area, wherein the notch area and a blower outlet area define a total blower outlet area, and wherein the notch includes a center portion that defines a portion of an elliptical shape.

8. The method in accordance with claim 7, wherein the notch includes at least one sloped portion adjacent the center portion.

9. The method in accordance with claim 7, wherein the notch includes two sloped portions each positioned adjacent the center portion.

10. The method in accordance with claim 9, wherein the notch further includes two flat portions each positioned adjacent at least one of the two sloped portions.

11. The method in accordance with claim 10, wherein the two flat portions each comprise a flat portion notch configured to reduce noise.

12. The method in accordance with claim 7, wherein the cutoff plate includes a plurality of acoustical treatments configured to reduce noise.

* * * * *